US011780197B2

(12) United States Patent
Johnson et al.

(10) Patent No.: US 11,780,197 B2
(45) Date of Patent: Oct. 10, 2023

(54) TOOL FOR USE IN ROBOTIC CASE ERECTING

(71) Applicant: R.A. Pearson Company, Spokane, WA (US)

(72) Inventors: Michael J. Johnson, Spokane, WA (US); David John Nelson, Spokane, WA (US)

(73) Assignee: Pearson Packaging Systems, Spokane, WA (US)

( * ) Notice: Subject to any disclaimer, the term of this patent is extended or adjusted under 35 U.S.C. 154(b) by 473 days.

(21) Appl. No.: 15/713,694

(22) Filed: Sep. 24, 2017

(65) Prior Publication Data

US 2018/0126683 A1 May 10, 2018

Related U.S. Application Data

(60) Provisional application No. 62/399,468, filed on Sep. 25, 2016.

(51) Int. Cl.

| | |
|---|---|
| ***B31B 50/07*** | (2017.01) |
| ***B31B 50/72*** | (2017.01) |
| ***B31B 50/04*** | (2017.01) |
| ***B31B 50/54*** | (2017.01) |
| *B31B 100/00* | (2017.01) |

(Continued)

(52) U.S. Cl.

CPC ..... *B31B 50/07* (2017.08); *B31B 50/046* (2017.08); *B31B 50/54* (2017.08); *B31B 50/726* (2017.08); *B31B 2100/0022* (2017.08); *B31B 2100/0024* (2017.08); *B31B 2110/35* (2017.08); *B31B 2120/302* (2017.08); *Y10S 901/27* (2013.01)

(58) Field of Classification Search

CPC ..... B31B 50/07; B31B 50/726; B31B 50/046; B31B 50/54; B31B 2100/0022; B31B 2120/302; B31B 2100/0024; B31B 2110/35; Y10S 901/27

USPC ..... 493/132, 309, 310, 311

See application file for complete search history.

(56) References Cited

U.S. PATENT DOCUMENTS 2,970,525 A * 2/1961 Klein ..... B65D 5/0227 493/129
3,626,819 A * 12/1971 Hoyrup ..... B31B 50/00 493/132

(Continued)

FOREIGN PATENT DOCUMENTS

| | | |
|---|---|---|
| JP | 2015074482 | 4/2015 |
| WO | WO2014088163 | 6/2014 |

OTHER PUBLICATIONS

The PCT Search Report and Written Opinion dated Dec. 21, 2017, for PCT/US17/53142, 9 pages.

*Primary Examiner* — Sameh Tawfik
(74) *Attorney, Agent, or Firm* — Lee & Hayes, P.C.

(57) ABSTRACT

The disclosure describes techniques for erecting cases, and particularly example structures and example methods for use in a case erecting system using a robotic arm. A tool for use in robotic case erecting may be used in conjunction with a robotic arm. Use of the tool assists in keeping a case level as the case moves along a conveyor, where a plow closes the major flaps and a tape head tapes edges of the flaps together, thereby sealing the bottom of the case. The tool also assists in regulating the gap between the major flaps, so that the gap and/or any overlap of the flaps is minimized. Accordingly, the tool assists the robotic arm to close the case in a more precise manner.

10 Claims, 13 Drawing Sheets

(51) Int. Cl.
*B31B 120/30* (2017.01)
*B31B 110/35* (2017.01)

(56) References Cited

U.S. PATENT DOCUMENTS

| | | | | | |
|---|---|---|---|---|---|
| 4,031,817 | A * | 6/1977 | Raschke | B31B 50/00 | 493/164 |
| 4,776,147 | A * | 10/1988 | Konzal | B65B 61/24 | 53/373.9 |
| 5,042,233 | A * | 8/1991 | Huang | B65B 5/061 | 53/242 |
| 5,514,068 | A * | 5/1996 | Calvert | B31B 50/00 | 493/312 |
| 5,928,123 | A | 7/1999 | Davis, Jr. | | |
| 7,390,291 | B2 | 6/2008 | Chen | | |
| 7,445,589 | B2 * | 11/2008 | Jaen | B31B 50/00 | 493/167 |
| 8,075,467 | B2 * | 12/2011 | Monti | B65B 43/28 | 493/177 |
| 8,128,547 | B2 * | 3/2012 | Graham | B31B 50/00 | 493/167 |
| 9,073,279 | B2 | 7/2015 | Pettersson | | |
| 9,718,570 | B1 | 8/2017 | Ortiz et al. | | |
| 2006/0117714 | A1 * | 6/2006 | Draghetti | B65B 5/024 | 53/458 |
| 2009/0291816 | A1 * | 11/2009 | Gebhardt | B65B 5/024 | 493/313 |
| 2013/0036716 | A1 * | 2/2013 | Tsutsumi | B65B 43/305 | 53/564 |
| 2014/0179501 | A1 * | 6/2014 | Akama | B25J 9/0096 | 493/162 |
| 2015/0324893 | A1 * | 11/2015 | Langen | G06Q 30/0635 | 705/26.81 |

* cited by examiner

TOOL FOR USE IN ROBOTIC CASE ERECTING

RELATED APPLICATIONS

This application is a nonprovisional application of, and claims priority to and the benefit of, U.S. Patent Application Ser. No. 62/399,468, filed Sep. 25, 2016, and entitled "Tool for Use in Robotic Case Erecting" the entirety of which is incorporated herein by reference.

BACKGROUND

Robotic arms may be used to erect cases in an automated packaging environment. Cases (e.g., cardboard boxes) may be purchased partially constructed and in a flattened and stacked state. In the erecting process, the robotic arm selects and opens a case, and folds the minor flaps (the first pair of opposing flaps to be folded that will form the inside bottom of the case) approximately 90-degrees into a closed position. The major flaps (the second pair of opposing flaps to be folded to form the outside bottom of the case) are then closed, so that edges of opposed flaps are adjacent. The major flaps are then taped together, such as by operation of a tape head.

Closing the major flaps may be performed by actions of the robotic arm, which grips the case and moves the case so that the major flaps come into contact with a plow. The plow, which may be active or passive, bends the flaps so that the long edge of each flap comes into contact with the long edge of the other flap. Once closed, the two edges of the major flaps are taped together, thereby sealing the bottom of the case. Once sealed, the case is in condition to receive product, before the top of the case is sealed.

Processes which bend the major flaps, and position the edges of those flaps adjacent to each other before taping, fail to consistently, and with desirable precision, position the edges in a parallel relationship. Instead, the edges frequently are separated by gaps, or may overlap. Such failure to properly position the major flaps tightly against each other, without gap or overlap, results in a case that when taped closed, is not sufficiently square and true.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

DETAILED DESCRIPTION

Overview

Figure 1:
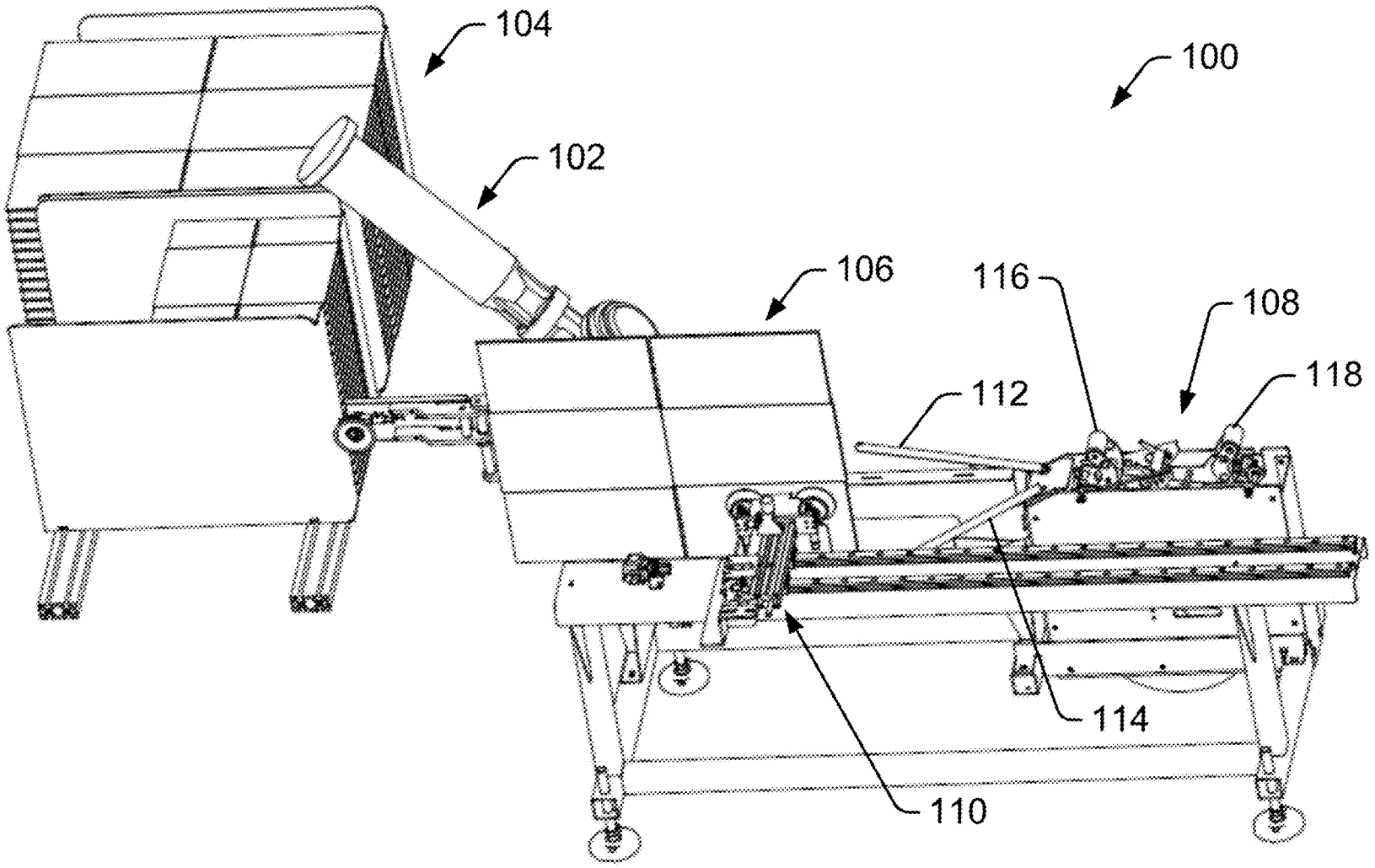
FIG. 1 is an isometric view of an example system within which an example tool for use in robotic case erecting could be used, showing a case that has been selected from a cassette of blank cases, but that has not yet been opened.

The disclosure describes techniques for erecting cases, and particularly example systems for use in case erecting, including example methods for use in a case erecting system using a robotic arm. A tool for use in robotic case erecting may be used in conjunction with a robotic arm. Use of the tool assists in keeping a case level as the case moves along a support structure, where a plow closes the major flaps and a tape head tapes edges of the flaps together, thereby sealing the bottom of the case. The tool also assists in regulating the gap between the major flaps, so that the gap and/or any overlap of the flaps is minimized. Accordingly, the tool assists the robotic arm to close the case in a more precise manner.

In an example, a system may include a cassette with one or more sizes of cases (e.g., cardboard boxes) in a folded-flat configuration. A robotic arm with an end-of-arm tool is configured to select and grasp one case, such as with a suction cup on the end-of-arm tool. The robotic arm may move the unopened case into contact with a tool for use in robotic case erecting, which is configured to attach to the unopened case. With the tool in a stationary position, the robotic arm may open the case by moving in a curved motion. The robotic arm may grasp the opened case on one side panel and the back panel (with respect to movement of the case on a conveyor), while the tool releases the case. The robotic arm may then manipulate the case against a rail of other surface, to thereby close the minor flaps on the bottom of the case. When the minor flaps are partly or fully closed, the robotic arm may then position the case so that the tool may grasp a side of the case opposite the robotic arm, such as by operation of suction cups on the tool. The robotic arm may then move the case into contact with a static (or dynamic) plow, to close the major flaps of the case. As the case moves, the tool slides on a track parallel to movement of the case, pulled along by the case, to which it is attached, while the case is moved by the robotic arm. As (or before) the case moves into contact with a tape head, the tool regulates the extension of the suction cups used to attach the tool to the case. By regulating the degree of extension of the suction cups, and by pushing (or pulling or holding) the side of the case with the suction cups, and by holding the leading edge of the case steady as it passes through the major flap plow and tape head, the tool is able to narrow any gap (or reduce any overlap) between the major flaps before they are taped together. Thus, by keeping the case level, restrained and properly located, as the flaps are plowed and sealed, the tool assists the robotic arm to close the flaps in an alignment that reduces any gap between, or overlap of, the flaps.

Regarding the distinction between major and minor flaps, the minor flaps are closed first, when sealing a case. The major flaps are closed after the minor flaps are closed. An edge of major flaps of two opposed sides of the case come together, and may be taped together. Unless the case is square, edges of the minor flaps will not come together, because the length of the case is longer than the combined length of the minor flaps. To further distinguish major and minor flaps, the edges of the major flaps, when closed, are in-line with the direction of case movement. Similarly, the tape sealing major flaps together is also in-line with the direction of case movement. In contrast, one minor flap is ahead of the other minor flap, as the case moves toward the tape head.

Example System and Techniques

FIG. 1 shows an example system 100 within which a tool 110 for use in robotic case erecting could be used. In the view of FIG. 1, a case 106 has been selected by a robotic arm 102 from a cassette 104 of blank cases. The robotic arm 102 is shown disembodied from its base, for overall clarity of the drawing. The robotic arm 102 supports the case 106 using suction cups (not shown) on the reverse side of the case, while the tool 110 for use in robotic case erecting supports the case on the opposite side. In the example shown, the tool 110 includes two suction cups that are attached to a flap of the case; however, the exact point of attachment depends on the goals of a particular design. A static (not powered) plow 112, 114 includes two elements configured to contact the major flaps of the case, and to close them as the case moves toward the tape head 108. The tape head 108 includes a leading roller 116, which first contacts the case, and a trailing roller 118. The tape head 108 applies tape to the edges of the major flaps, thereby sealing them together and closing the bottom of the case so that it may be filled with product before the top is sealed.

Figure 2:
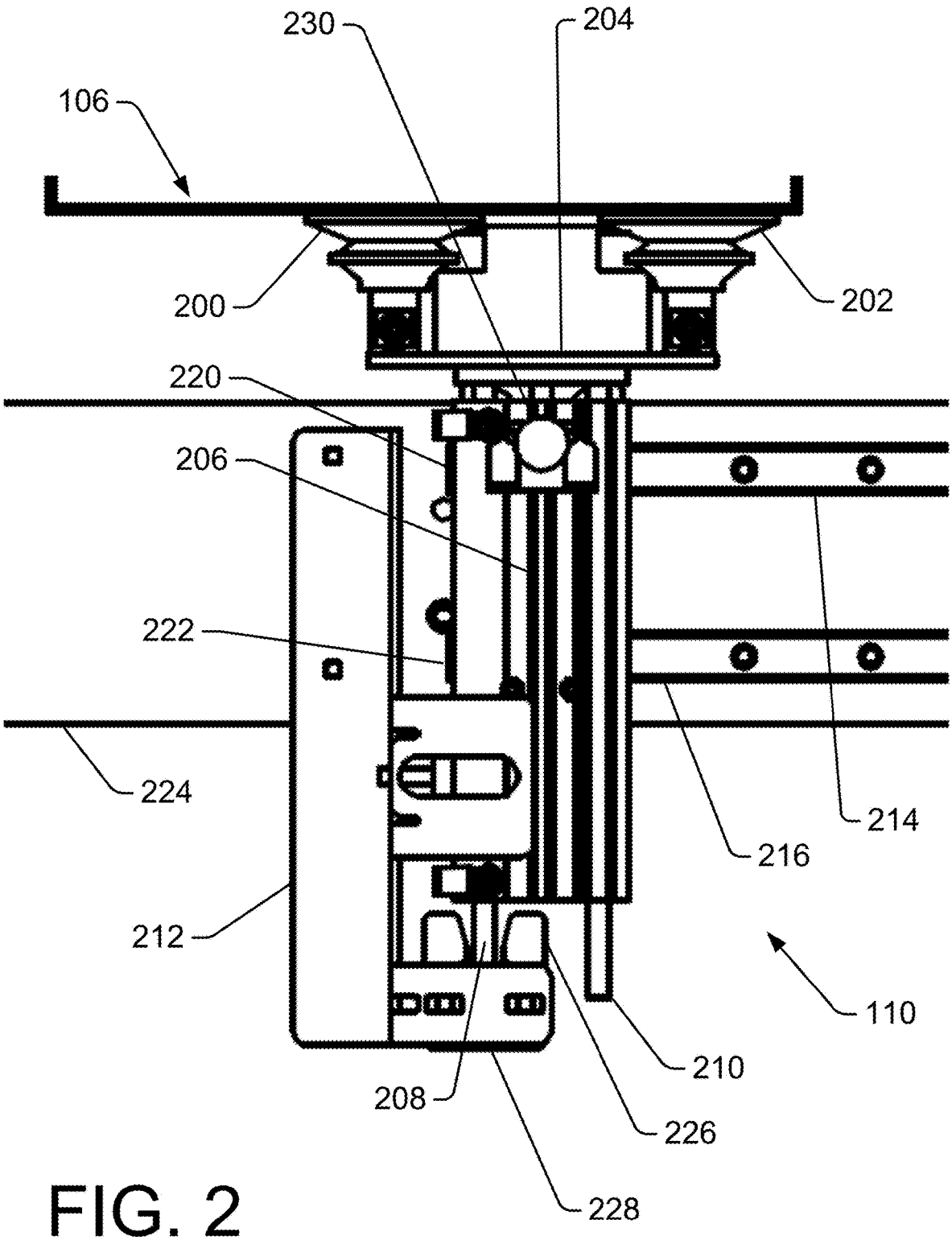
FIG. 2 is an orthographic view of the example tool for use in robotic case erecting.

FIG. 2 shows an example tool 110 for use in robotic case erecting. The tool 110 includes two suction cups 200, 202, supported by a bracket 204, and in the view shown, attached to a portion of the case 106. The bracket 204 and suction cups 200, 202 may be advanced and retracted by operation of an actuator, (e.g., a cylinder-with-slide-rod 206), which may be air-powered. Alternatively, the actuator may be powered by a servo or stepper motor, etc. The bracket 204 and suction cups 200, 202 may be supported by a pair of guide rods 208, 210. The slide rod 206 extends the suction cups 200, 202 a precise and controlled distance from the tool 110, which is configured to move along one or more tracks 214, 216. Accordingly, extension of the slide rod 206 positions the suction cups 200, 202 in a manner that precisely controls the position of adjacent edges of two flaps to be sealed (e.g., taped) together. Thus, operation of the slide rod and suction cups positions the edges of the flaps for taping without gap or overlap. In the example shown, bearings 220, 222 allow the tool 110 to move on the tracks 214, 216. In an alternative example, only one track and one bearing are used to support tool 110 for movement. The track(s) may be supported by a beam 224 or bracket.

One or more stops 226 may be used to restrain the tool 110 when the bracket 204 and suction cups 200, 202 are retracted, thereby positioning a guide rod 208 behind the stop. The stops may be supported by bracket 212. A carriage return knob 230 may be made of rubber or other material, and provides a post for contact by the robotic arm, allowing the robotic arm to push the tool 110 on the rails 214, 216, back to a starting position, after a case has been opened and the flaps closed and sealed.

A controller 228 receives signals over a wiring harness (not shown) and compressed air tubing (not shown). The signals active one or more solenoids, to thereby provide and release a partial vacuum to the suction cups 200, 202 as needed. The controller 228 also regulates the extension of the slide rod 206 from its cylinder, which regulates the position of the suction cups 200, 202. By extending or retracting the suction cups 200, 202, the distance between opposed sides of the case 106 can be controlled, which assists in regulating and minimizing a gap and/or overlap between opposed flaps before they are sealed with tape by the tape head 108. In the example shown, the controller 228 is supported by bracket 212. In a further example, spacing between the folded flaps of the case is controlled at least in part by the actuator, a position or location of suction cups 200, 202, controlled by the actuator, and at least in part by the robotic arm and its position.

Figure 3:
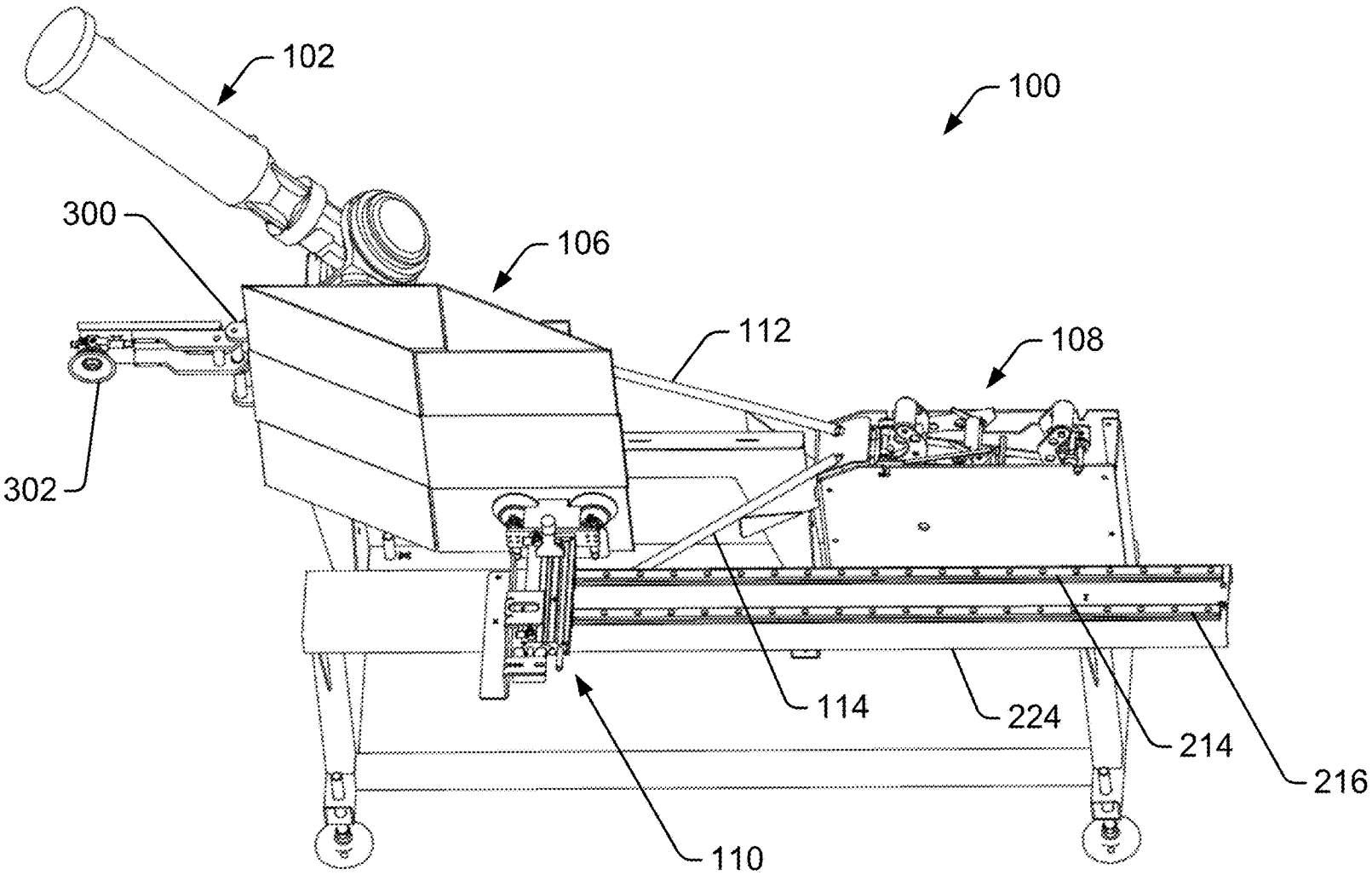
FIG. 3 is an isometric view of the example system, showing a case that is partially opened.

FIG. 3 shows the example system 100, including a case 106 that is partially opened. The robotic arm 102 is moving in an arc, to open the case 106, while the tool 110 holds one flap of the case in a fixed location. The end-of-arm tool 300 of the robotic arm 102 includes a plurality of suction cups 302, including one or more suction cups (not shown) attached to the case 106. The plow configured to close the major flaps includes two elements 112, 114, which have not yet contacted the case 106. The tool 110 has not yet begun to move on the tracks 214, 216, supported by the beam 224.

Figure 4:
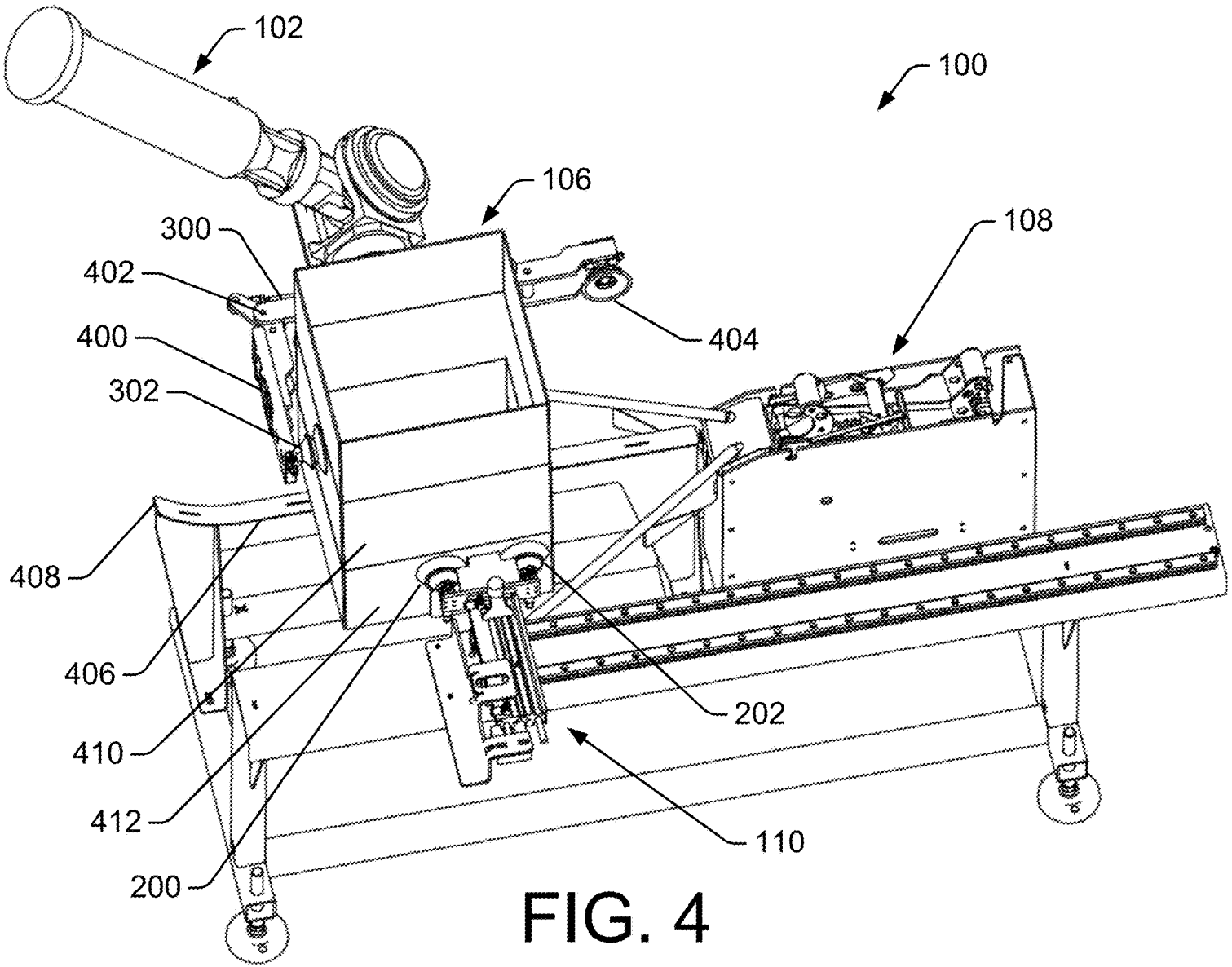
FIG. 4 is an isometric view of the example system, showing a case that is fully opened.

FIG. 4 shows the example system, including a case 106 that is fully opened—however the bottom flaps have not been folded, and the major flaps have not yet been sealed (taped). The robotic arm 102 has moved a pivoting portion 400 the end-of-arm tool 300 into a position wherein the portion 400 of the end-of-arm tool, pivoting about hinge 402, contacts the back of the case 106 with suction cup 302. A suction cup 404 of the end-of-arm tool 300 is adapted for use with cases oriented in a mirror image of the case shown, wherein the robotic arm 102 must pivot in a direction opposite to the direction used to open the case shown. Such cases may be pulled by suction cup 404, rather than pushed by suction cup 302, through the major flap plows and tape head 108.

A rail 406 is located in a center-line of the case 106. A curved portion 408 of the rail 406 is adapted to assist the robotic arm 102 to bend the minor flaps, prior to closing the major flaps of the bottom of the case 106. Thus, the rail and/or the curved portion of the rail, are configured to provide a surface usable by the robotic arm to press the minor flaps against to close them. In an example, the robotic arm 102 moves the case against the rail 406 and/or curved portion 408, to bend the minor flaps of the case. One of the major side panels 410 and major flaps 412 are seen in this view. The suction cups 200, 202 of the tool 110 are attached to the major flap 412, rather than the major side 410, so that there is room to erect the case over the top of curved portion 408.

Figure 5:
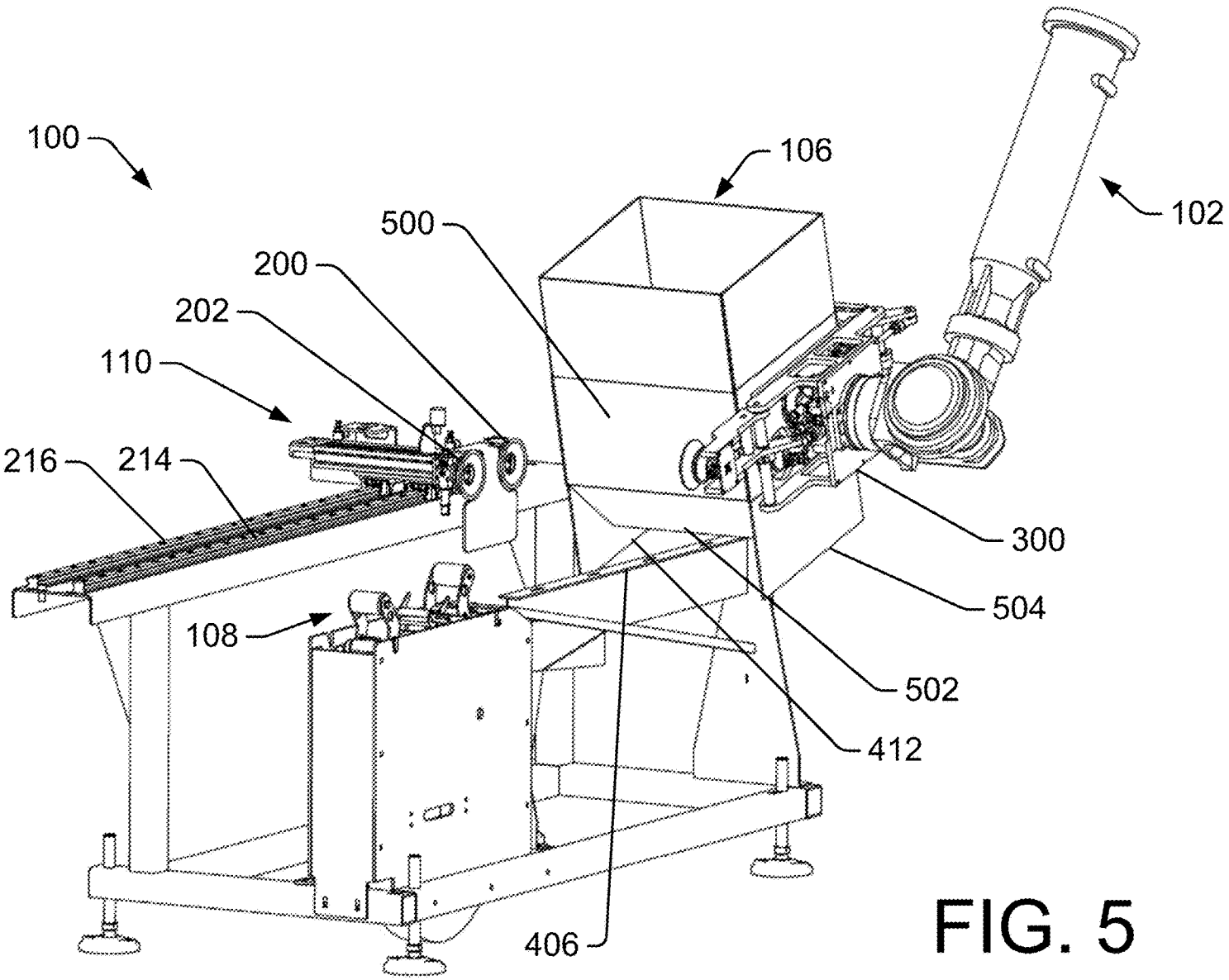
FIG. 5 is an isometric view of the example system, wherein the tool for use in robotic case erecting has released the case, and a robotic arm is in the process of closing the minor flaps in a fully opened case.

FIG. 5 shows the example system 100 in a position wherein the suction cups 200, 202 of the tool 110 have released the case 106, and the robotic arm 102 is in the process of closing the minor flap 502 (and one minor flap that is not in the view of FIG. 5) of the fully opened case. Accordingly, the tool 110 is configured to release its grasp on the case while the robotic arm manipulates the case to close minor flaps of the case. In the view of FIG. 5, the robotic arm 102 and end-of-arm tool 300 are moving the case 106 in a manner that closes the minor flap 502 and an opposite minor flap (not shown) by pushing each flap against the rail 406 and/or the curved portion 408 of the rail. In this example, while the minor flaps are being closed, the major flaps 412, 504 have not yet been closed and the tool 110 has not yet moved along the track 214, 216. The leading minor side 500 of the case 106 is seen in this view.

Figure 6:
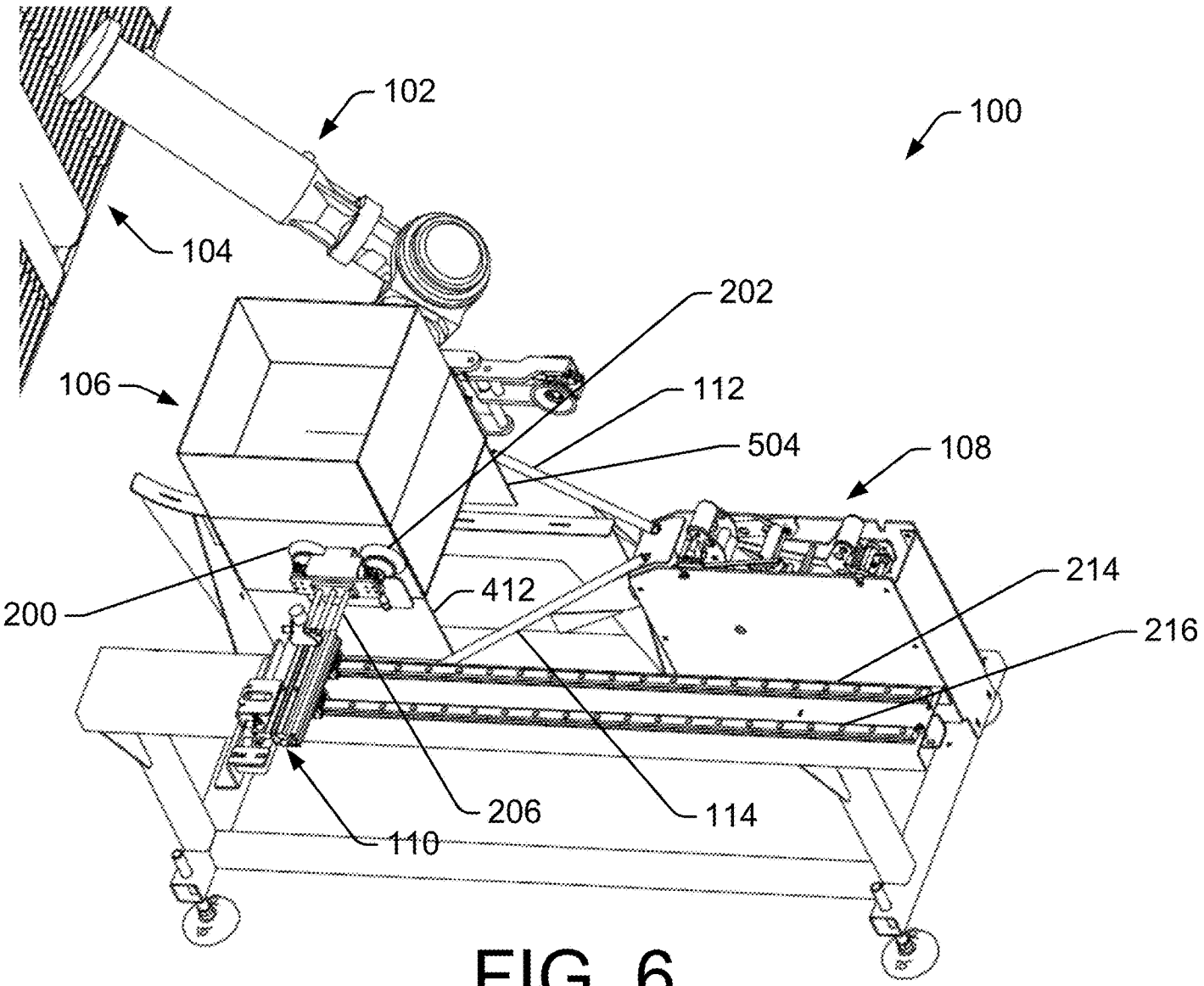
FIG. 6 is an isometric view of the example system, wherein the tool for use in robotic case erecting has reattached to the case, and the major flaps are about to contact static plows that will begin to close them.

FIG. 6 shows the example system 100 in a position wherein the slide rod 206 of tool 110 has extended from its cylinder and positioned the suction cups 200, 202 to touch and attach to the case 106. In the example, the robotic arm 102 has moved the case 106 into a position wherein the suction cups 200, 202 are able to grasp the major side of the case 106. The major flaps 412, 504 are about to contact static plows 112, 114 that will begin to close those flaps. In particular, major flap 412 will contact plow 114 and major flap 504 will contact plow 112 as the case 106 is advanced under power of the robotic arm 102 toward the tape head 108. Because the tool 110 has attached to the case 106 by operation of a vacuum applied to the suction cups 200, 202, the tool will travel on the tracks 214, 216 as the case moves.

Figure 7:
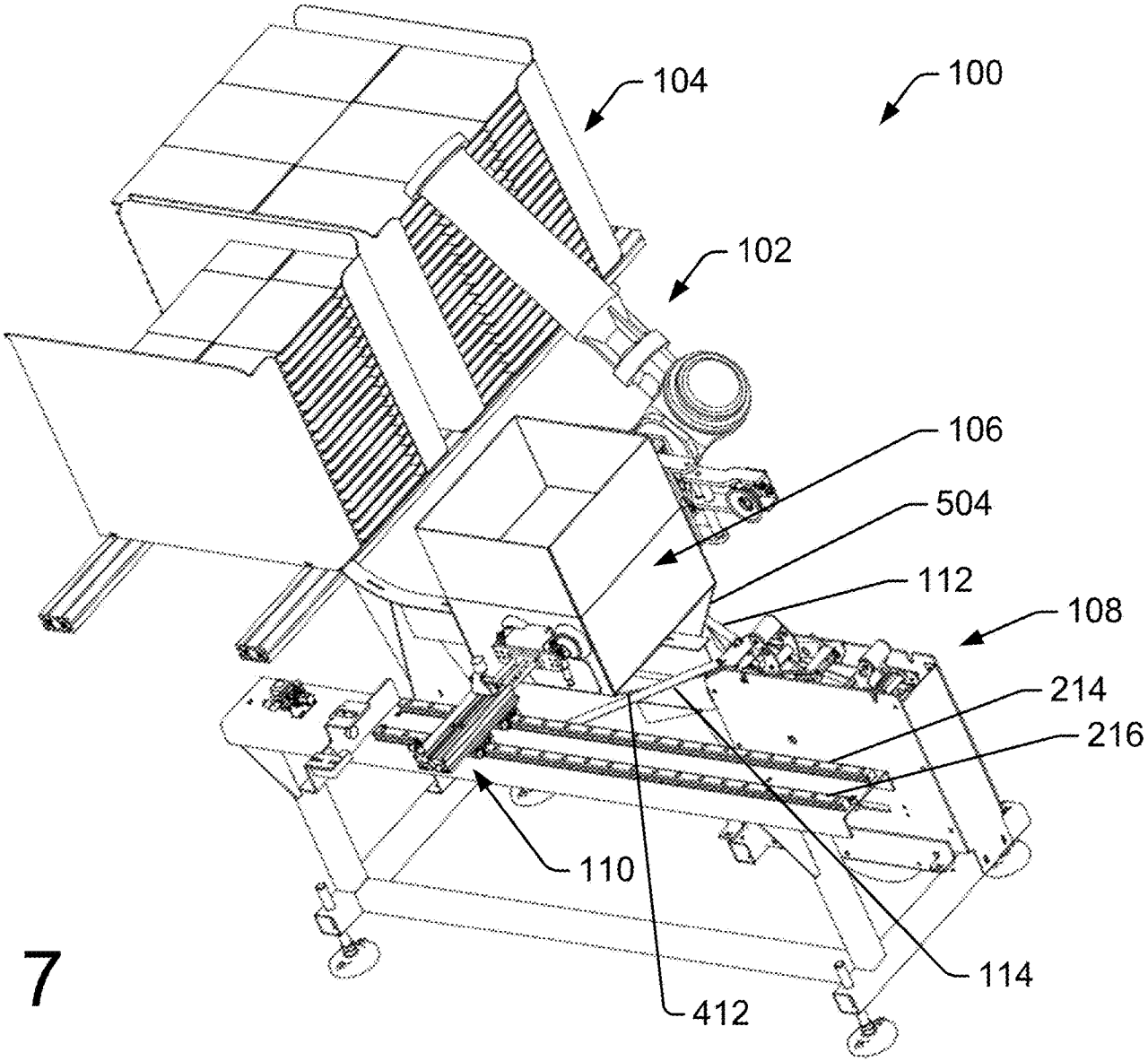
FIG. 7 is an isometric view of the example system, wherein the major flaps have contacted the static plows, and are beginning to close.

FIG. 7 shows the example system 100, in a position wherein the major flaps 412, 504 have contacted the static plows 114, 112, respectively. Accordingly, the major flaps are beginning to close. The tool 110 is moving on the tracks 214, 216, due to the tool's connection to the case, which is moving under power of the robotic arm 102. Thus, a plow (e.g., including left and right plows) folds the major flaps of the case once the case is opened. The folding may be responsive to movement of the robotic arm pushing the case against the plows. As the case moves, the tool (grasping a side of the case) slides on a track responsive to movement of the case.

Figure 8:
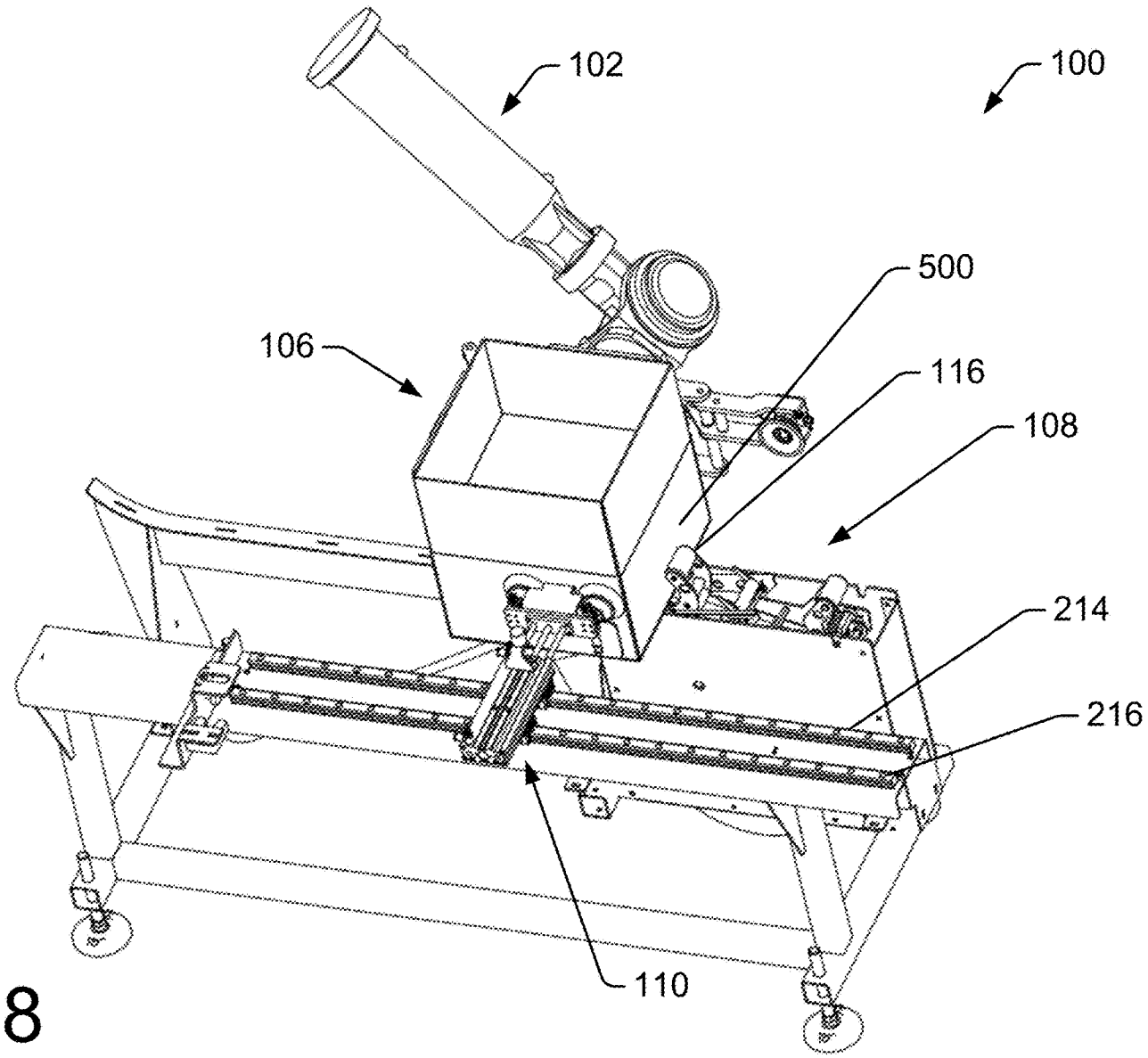
FIG. 8 is an isometric view of the example system, wherein the major flaps have been closed, and the case has come into contact with the tape head.

FIG. 8 shows the example system 100 in a position wherein the major flaps have been closed, and the leading minor side 500 of the case has come into contact with the leading roller 116 of the tape head 108. The tool 110 continues to move along the tracks 214, 216 due to its attachment to the case 106, which is moved by operation of the robotic arm.

Figure 9:
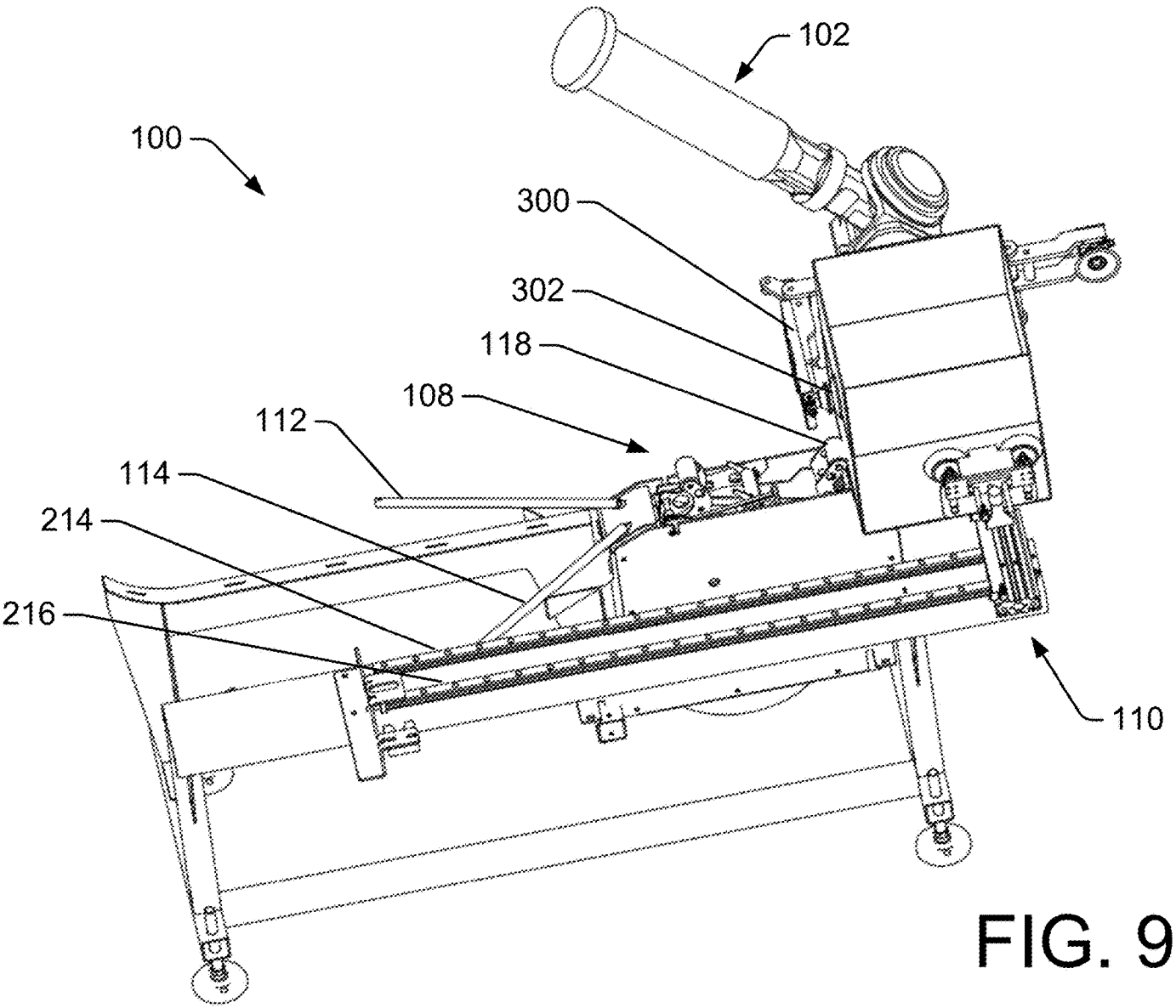
FIG. 9 is an isometric view of the example system, wherein the tape head has sealed the major flaps on the bottom of the case.

FIG. 9 shows the example system 100 in a position wherein the tape head 108 has sealed the major flaps on the bottom of the case 106. The trailing roller 118 of the tape head 108 is pressing tape onto the trailing minor side of the case. The end-of-arm tool 300 of the robotic arm 102 continues to grasp one major side of the case 106, and the trailing minor side of the case with suction cup 302. The tool 110 has moved to a position at the end of the tracks 214, 216. At this point, the tool 110 will release the case 106, such as by ending the vacuum applied to the suction cups holding the tool to the case.

Figure 10:
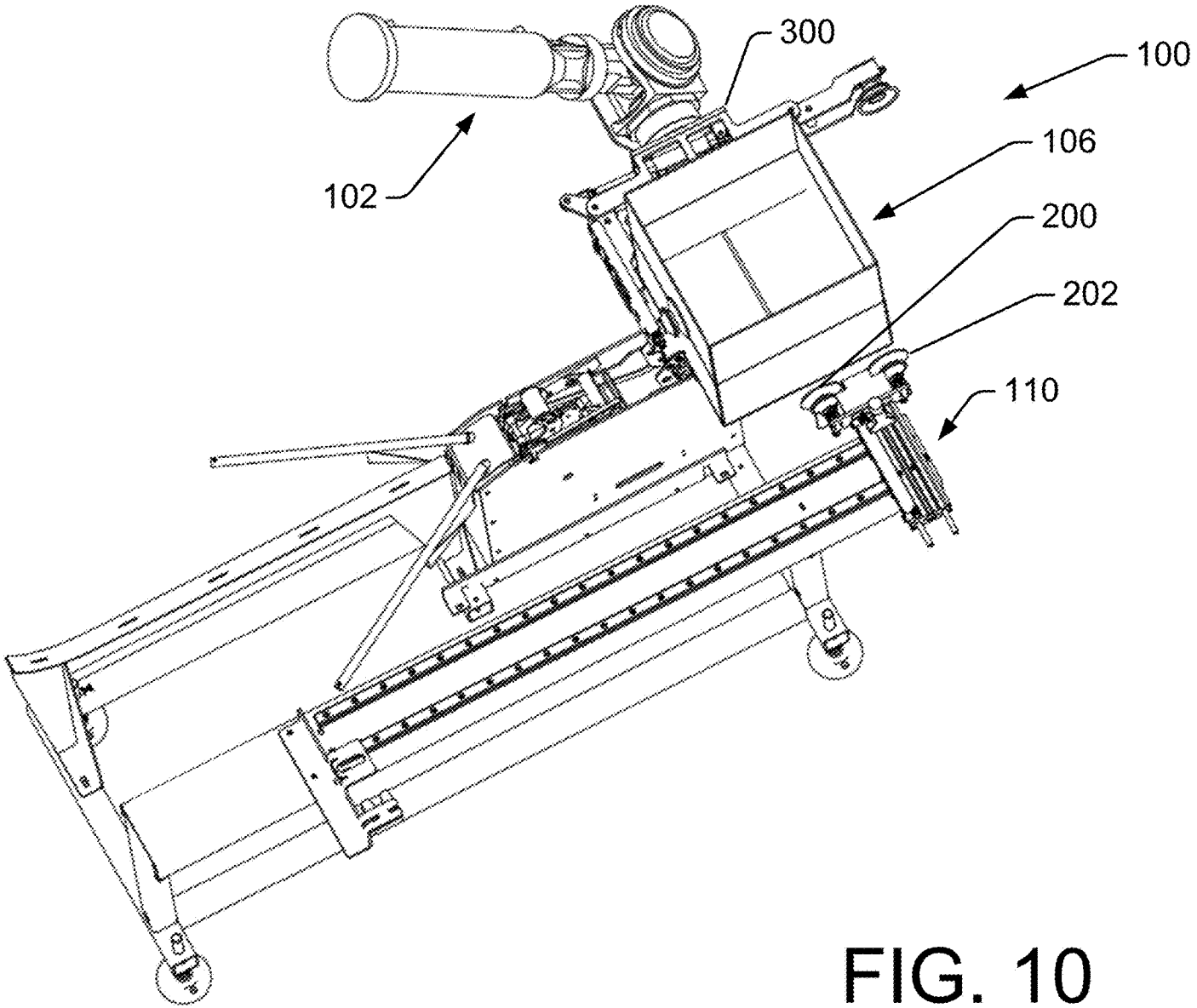
FIG. 10 is an isometric view of the example system, wherein the tool for use in robotic case erecting has released the case, which is supported by the robotic arm.

FIG. 10 shows the example system 100 in a position wherein the suction cups 200, 202 of the tool 100 have released the case 106. The case is then supported by the end-of-arm tool 300 of the robotic arm 102.

Figure 11:
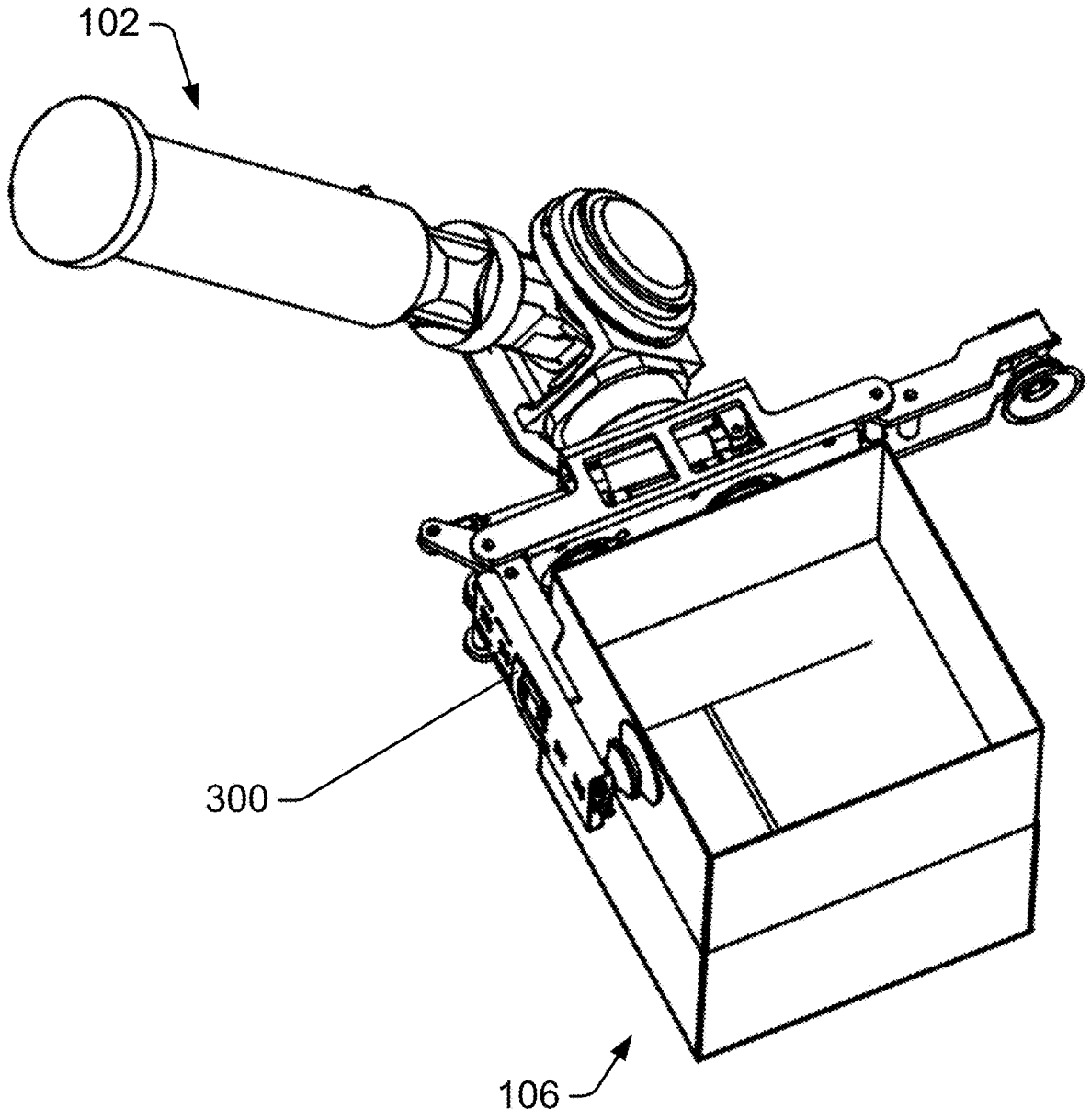
FIG. 11 is an isometric view of the robotic arm carrying the fully opened case, having its bottom flaps sealed.

FIG. 11 shows the end-of-arm tool 300 of the robotic arm 102 carrying the case 106, which is fully erected and has its bottom flaps sealed.

Example Methods

Figure 12A:
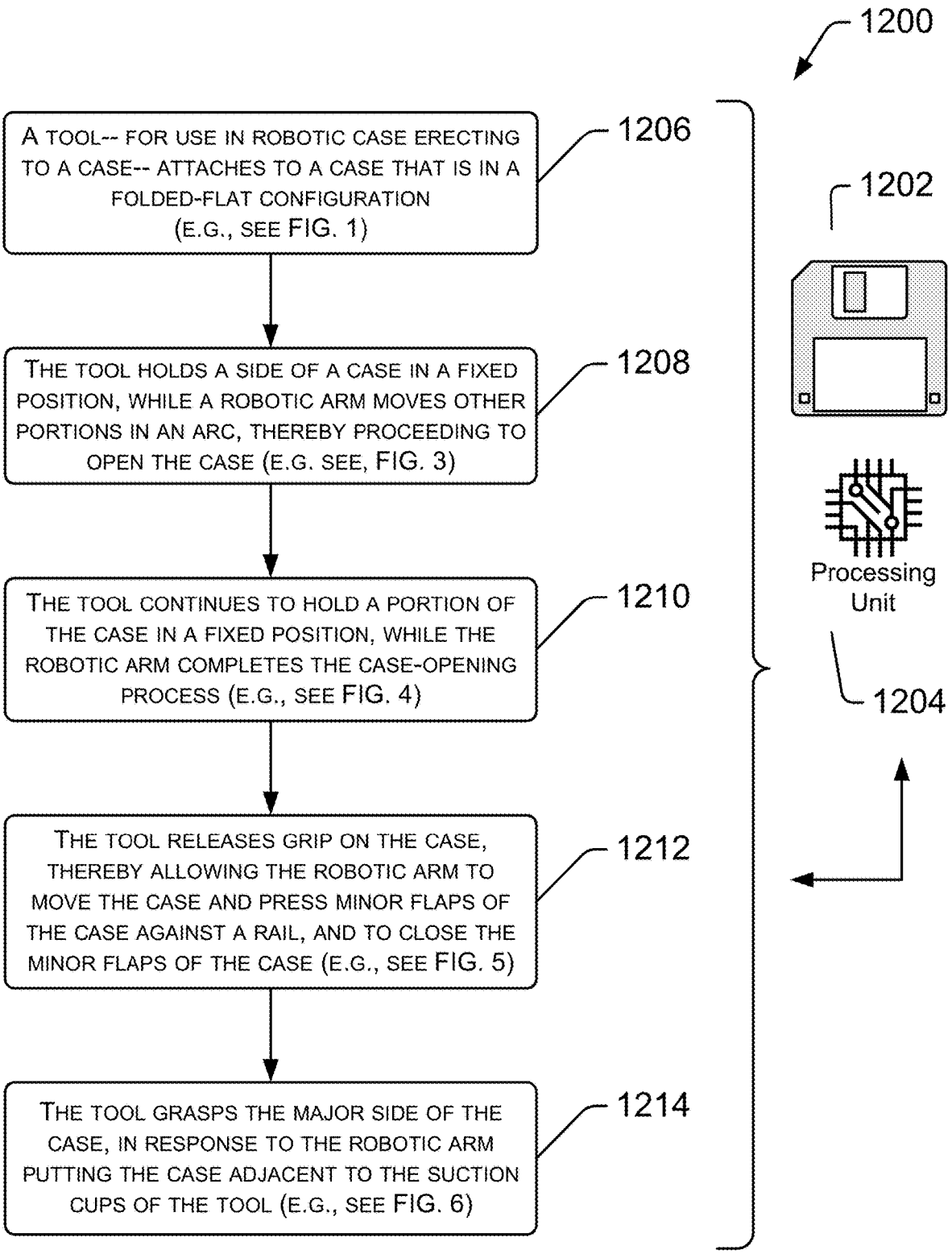
FIGS. 12A and 12B are a flow diagram showing an example method by which the system, including the tool for use in robotic case erecting, may be used to open and seal flaps on a case.
Figure 12B:
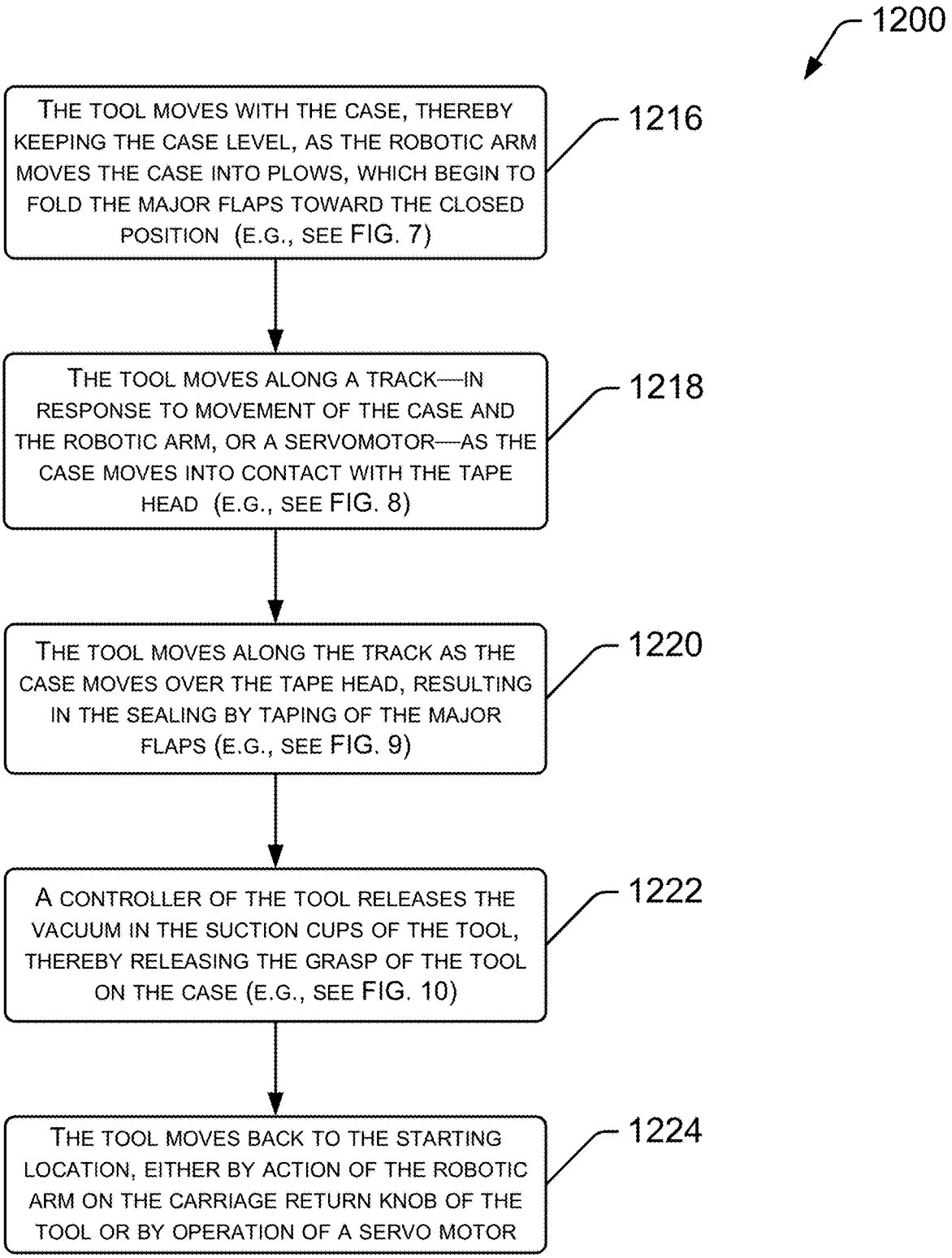

FIGS. 12A and 12B, when viewed in a unified format as FIG. 12, are a flowchart showing example methods and operation of a device or tool for use in robotic case erecting. The methods and operation may be performed and/or directed by any desired processor 1204, memory 1202, integrated circuit, logic devices, programming, etc. The controller 228 may include one or more of the processor 1204, memory 1202 and/or other devices. The example methods of FIG. 12 may be implemented at least in part using the structures and techniques illustrated by FIGS. 1-11. However, the methods of FIG. 12 contain general applicability, and are not limited by other drawing figures and/or prior discussion. The functional blocks of FIG. 12 may be implemented by software and/or hardware structures or devices that are configured to operate a device or tool for use in robotic case erecting. In one example, one or more functional blocks may be implemented by aspects including a device or tool for use in robotic case erecting controlled by a microprocessor, a ladder logic device, a microcontroller or other logic device, etc., one or more memory devices, computer-readable media, application specific integrated circuits, software blocks, subroutines, programs, etc.

In some examples of the techniques discusses herein, the methods of operation may be performed by one or more application specific integrated circuits (ASIC) or may be performed by a general-purpose processor utilizing software defined in computer readable media. In the examples and techniques discussed herein, the memory 1202 may comprise computer-readable media and may take the form of volatile memory, such as random access memory (RAM) and/or non-volatile memory, such as read only memory (ROM) or flash RAM. Computer-readable media devices include volatile and non-volatile, removable and non-removable media implemented in any method or technology for storage of information such as computer-readable instructions, data structures, program modules, or other data for execution by one or more processors of a computing device. Examples of computer-readable media include, but are not limited to, phase change memory (PRAM), static random-access memory (SRAM), dynamic random-access memory (DRAM), other types of random access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transitory medium that can be used to store information for access by a computing device.

As defined herein, computer-readable media does not include transitory media, such as modulated data signals and carrier waves, and/or signals.

FIGS. 12A and 12B show an example method 1200 by which a system, including a tool for use in robotic case erecting, may be used to open a case and seal flaps of the case. Thus, the method is described particularly with respect to a tool for use in case erection (e.g., tool 110), the robotic arm 102, and other tools, devices and assemblies, as seen in FIGS. 1-11. However, the method 1200 may alternatively be used with different systems, based on design requirements of a system.

At block 1206, a tool for use in robotic case erecting attaches to a case. The case may be in a folded-flat configuration at the time of attachment. The case may have been moved into the proximity of the tool by a robotic arm, and the tool may attach to the case, such as by operation of suction cups attached to a vacuum source, when the arm brings it into contact with the tool. Referring to the example of FIG. 1, a robotic arm 102 having an end-of-arm tool 300 that may include a plurality of suction cups has selected and grasped a case 106 from a cassette 104, which may have a plurality of differently sized cases. The robotic arm 102 has moved the case 106 into a position so that the tool 110 may attach to the case. The tool 110 may advance, retract and precisely control the location of the suction cups 200, 202 by means of the cylinder with slide rod 206 (seen in FIG. 2). Accordingly, by use of the cylinder with slide rod 206, the suction cups 200, 202 may be precisely located, and by control of a partial vacuum applied to the suction cups, their grasp and/or release may be controlled.

At block 1208, the tool for use in robotic case erecting holds a side of a case in a fixed position, while the robotic arm moves other portions of the case in an arc, thereby opening the case from the folded-flat configuration. Referring to the example of FIG. 3, the tool 110 is seen holding a lower flap of the case in a fixed position, while the robotic arm 102 and end-of-arm tool 300 begins to open the case. In FIG. 3, the case is only shown partially open, i.e., intermediate between folded flat and rectangular. The tool 110 can hold the lower flap by maintaining a partial vacuum within the suction cups 200, 202.

At block 1210, the tool for use in robotic case erecting continues to hold a portion of the case in a fixed position, while the robotic arm completes the case-opening process. Referring to the example of FIG. 4, the robotic arm 102 has fully opened the case 106 into a rectangular form with 90-degree corners. The tool 110 continues to hold one major flap 412 of the case 106 at a location precisely controlled by the degree of extension of the suction cups, as controlled by the degree of extension of the slide rod 206. Additionally, portions of the end-of-arm tool 300 have pivoted to grasp a second side of the case. In particular, the pivoting portion 400 of the end-of-arm tool 300 has grasped the back side (with respect to left-to-right movement along the conveyor) of the case. Alternatively, with a mirror image case, the suction cup 404 would pivot to attach to the front side of the case.

At block 1212, the tool for use in robotic case erecting releases its grip on the case, thereby allowing the robotic arm to move the case and press minor flaps of the case against a rail, and to thereby close the minor flaps of the case. Referring to the example of FIG. 5, the tool 110 has released the case 106, such as by releasing the vacuum applied to the suction cups 200, 202. The robotic arm continues to grasp the case 106 with the end-of-arm tool 300, and proceeds to bend the minor flaps into a closed position. The bending process may involve pressing the minor flaps 502 against the rail 406.

At block 1214, the tool for use in robotic case erecting grasps the major side of the case, in response to the robotic arm putting the case adjacent to the suction cups of the tool. The end-of-arm tool of the robotic arm continues to grasp the case on the other major side, and the trailing minor side of the case. Referring to the example of FIG. 6, the tool 110 has grasped the major side of the case 106 using its suction cups 200, 202. Thus, while the tool 110 grasped the major flap 412 in FIGS. 1, 3 and 4, the tool grasps the major side (not flap) of the case in FIG. 6. With the minor flaps closed (block 1212), the minor side of the case is at the elevation of the tool 110, and the tool grasps the minor side. This gives the tool a solid grip on the case, as the major flaps contact the plows to be closed. The end-of-arm tool 300 of the robotic arm 102 grasps the side and back of the case.

At block 1216, the tool for use in robotic case erecting moves with the case, as the robotic arm moves the case into plows. Contact with the plows begins to close the major flaps of the bottom of the case. The tool keeps the case level and square as the case contacts the plows, and helps to control a distance by which the opposed major sides are separated so that the major flaps will close without gap or overlap, as the major flaps move through the tape head. The tool may move passively, as a result of its attachment to the case, which is being propelled forward by the robotic arm. Alternatively, the tool may be moved actively, such as by operation of servo motor, air cylinders or other means. The tool may move along one or more tracks, and may be supported by linear bearings or similar. A comparison of FIGS. 6 and 7 indicate that the tool 110 has moved somewhat (along tracks 214, 216, labeled in FIG. 6) in response to its grasp on the case 106, which is moved by the robotic arm 102. As the case 106 contacts the plows 112, 114, the tool 110 tends to keep the case more square and level that it would otherwise be, particularly in view of the forces applied to the case by the plows. Thus, the distance between the major flaps may be precisely controlled. In an example, the cylinder with slide rod 206 (see FIG. 2) may be extended a precise distance calculated to position the suction cups 200, 202 at a precise location to separate the two major sides of the case by a precise distance and to thereby result in the major flaps touching without overlap or gap when fully folded. Accordingly, edges of the major flaps are positioned with minimal gap and/or overlap as the case heads for the tape head.

At block 1218, the tool for use in robotic case erecting moves along its track—e.g., in response to movement of the case and the robotic arm—as the case moves into contact with the tape head. In the example of FIG. 8, the tool 110 has moved along its track 214, 216 in response to movement of the case 106 to the point that the case has contacted the leading roller 116 of the tape head 108. Alternatively, if the tool 110 is powered by a servo motor, then the movement of the tool 110 would be the same or similar, but the movement would be in response to the servo motor and not in response to movement of the case 106. Use of a servo motor may result in greater precision of alignment of the major flaps, but may result in additional cost.

At block 1220, the tool for use in robotic case erecting moves along its track as the case moves over the tape head, and the major flaps are taped together. In the example of FIG. 9, the tool 110 has moved along its track 214, 216 in response to movement of the case 106 to the point that the case is just about to pass the trailing roller 118 of the tape head 108. The trailing roller 118 presses the end of the piece of tape, used to seal the major flaps (tape them together), against the trailing minor side of the case. Because the tool 110 used the cylinder with slide rod 206 to control the location of the suction cups which held the major side of the case opposite the major side held by the robotic arm, the distances between the sides of the case are precisely controlled. Accordingly, the edges of the major flaps are precisely controlled as the tape is applied by the tape head, and the gap between the flaps is precisely controlled.

At block 1222, the tool for use in robotic case erecting releases the vacuum in its suction cups, thereby releasing the grasp of the tool on the case. At this point, the robotic arm is able to move the case to a preferred location, such as a station wherein product is added to the case. In the example of FIG. 10, the tool 110 has released the case 106, such as by releasing the vacuum in suction cups 200, 202.

At block 1224, the robotic arm moves the opened case, having its bottom flaps closed and sealed, to a predesignated area. The robotic arm may move the tool back to the starting location, seen in FIGS. 1 and 3-6. The robotic arm may push the tool 110 (e.g., by pushing on the carriage return knob 230, shown in FIG. 2), along the tracks, back to the starting location. In a servo motor powered version of the tool 110, the servo motor would move the tool back to the starting location.

CONCLUSION

Although the subject matter has been described in language specific to structural features and/or methodological acts, it is to be understood that the subject matter defined in the appended claims is not necessarily limited to the specific features or acts described. For example, while the techniques have been described with reference to the minor flaps being folded first, and the major flaps being taped closed, the reverse could be performed. Accordingly, the specific features and acts are disclosed as exemplary forms of implementing the claims.

What is claimed is:

1. A system for erecting a case, comprising:

one or more memory devices;

a robotic arm, operated by execution of programming defined in the one or more memory devices;

an end-of-arm tool, connected to an end of the robotic arm and operated by execution of programming defined in the one or more memory devices, which when executed cause the end-of-arm tool to grasp a first side of the case, and to open the case by movements of the robotic arm and end-of-arm tool;

a plow to fold flaps of the case after the case is opened, wherein the flaps of the case are folded responsive to execution of programming defined in the system that moves the robotic arm to push the case against the plow;

a tool, operated by execution of programming defined in the one or more memory devices, which when executed cause the tool to grasp a second side of the case, wherein grasping the case by the tool causes the tool to move responsive to movement of the case as the case is moved by the robotic arm; and a track oriented parallel to a direction of travel of the case, and supporting the tool for movement parallel to the case, wherein the tool moves passively supported by linear bearings sliding on the track, wherein the tool and the track are separated from the robotic arm and the end-of-arm tool by a distance, and wherein movement of the tool motivated by attachment of the tool to the case as the case is propelled by the robotic arm.

2. The system of claim 1, wherein the tool additionally comprises executable programming defined in the one or more memory devices to change its grasp from the second side of the case, held while the robotic arm opens the case, to a second side of the case, held as the robotic arm moves the case into the plow.

3. The system of claim 1, wherein the tool additionally comprises executable programming, which when executed causes the tool to release its grasp on the case while the robotic arm manipulates the case to close minor flaps of the case.

4. The system of claim 1, additionally comprising: a rail to provide a surface against which the robotic arm may press minor flaps to close them, wherein execution of programming controlling operation of the tool releases a grasp by the tool of the case prior to contact by the minor flaps on the rail.

5. The system of claim 1, additionally comprising:

an actuator to position suction cups of the tool and to control spacing between the folded flaps of the case before they are sealed.

6. The system of claim 1, additionally comprising:

a carriage return knob on the tool, to allow the robotic arm to push the tool along the track in a direction opposite to movement by the tool as it slid on the track responsive to movement of the case.

7. The system of claim 1, additionally comprising:

a tape head, to seal opposed flaps of the case; and an actuator that positions a location of suction cups of the tool that are attached to the case to regulate a gap between opposed flaps at least in part by advancement or retraction of the actuator.

8. The system of claim 1, additionally comprising:

an actuator to position suction cups of the tool;

wherein spacing between the folded flaps of the case is controlled at least in part by the actuator and the robotic arm.

9. A system for erecting a case, comprising:

one or more memory devices;

a robotic arm, to operate by execution of programming defined in the one or more memory devices;

an end-of-arm tool, connected to an end of the robotic arm and operated by execution of programming defined in the one or more memory devices, which when executed cause the end-of-arm tool to grasp a first side of the case, and to open the case by movements of the robotic arm and end-of-arm tool;

a plow to fold flaps of the case after the case is opened, wherein the flaps of the case are folded responsive to execution of programming defined in the system that moves the robotic arm to push the case against the plow;

a tool, comprising executable programming defined in the one or more memory devices to activate and deactivate suction cups and to cause the tool to grasp a second side of the case, wherein grasping the case by the tool causes the tool to move responsive to movement of the case as the case is moved by the robotic arm; and a track, oriented parallel to a direction of travel of the case, to support the tool for movement parallel to the case, wherein the tool and the track are separated from, and not connected to, the robotic arm and the end-of-arm tool, wherein the tool moves passively on the track without motorized power, and wherein movement of the tool along the track results from attachment of the tool to the case as the case is propelled by the robotic arm.

10. A system for erecting a case, comprising:

one or more memory devices;

a robotic arm, to operate by execution of programming defined in the one or more memory devices;

an end-of-arm tool, connected to an end of the robotic arm and to operate by execution of programming defined in the one or more memory devices, which when executed cause the end-of-arm tool to grasp a first side of the case, and to open the case by movements of the robotic arm and end-of-arm tool;

a tape head to seal flaps of the case, wherein the flaps of the case are sealed responsive to execution of programming defined in the system that moves the robotic arm to push the case into contact with the tape head;

a tool, to activate and deactivate suction cups by execution of programming defined in the one or more memory devices, which when executed cause the tool to grasp a second side of the case, wherein grasping the case by the tool causes the tool to move responsive to movement of the case as the case is moved by the robotic arm; and a track, oriented parallel to a direction of travel of the case, to support the tool for movement parallel to the case, wherein the tool and the track are separated from, and not connected to, the robotic arm and the end-of-arm tool, wherein the tool is to move passively on the track without motorized power, and wherein movement of the tool along the track results from attachment of the tool to the case as the case is propelled by the robotic arm.

* * * * *